US011905834B2

(12) United States Patent
Chen et al.

(10) Patent No.: US 11,905,834 B2
(45) Date of Patent: Feb. 20, 2024

(54) SHIELD SEALING DEVICE AND SHIELD SEALING METHOD

(71) Applicants: CHINA RAILWAY 14TH BUREAU GROUP CO., LTD., Shandong (CN); OCEAN UNIVERSITY OF CHINA, Shandong (CN)

(72) Inventors: Jian Chen, Shandong (CN); Shuchen Li, Shandong (CN); Bin Zhi, Shandong (CN); Chengzhen Wang, Shandong (CN); Penglin Li, Shandong (CN); Hongjun Liu, Shandong (CN)

(73) Assignees: CHINA RAILWAY 14TH BUREAU GROUP CO., LTD., Shandong (CN); OCEAN UNIVERSITY OF CHINA, Shandong (CN)

( * ) Notice: Subject to any disclaimer, the term of this patent is extended or adjusted under 35 U.S.C. 154(b) by 0 days.

(21) Appl. No.: 17/602,746

(22) PCT Filed: May 7, 2020

(86) PCT No.: PCT/CN2020/088937
§ 371 (c)(1),
(2) Date: Oct. 9, 2021

(87) PCT Pub. No.: WO2021/196339
PCT Pub. Date: Oct. 7, 2021

(65) Prior Publication Data

US 2023/0037876 A1 Feb. 9, 2023

(30) Foreign Application Priority Data

Mar. 30, 2020 (CN) ..... 202010239524.1

(51) Int. Cl.
*E21D 9/14* (2006.01)
*E21D 9/06* (2006.01)

(52) U.S. Cl.
CPC ..... *E21D 9/0635* (2013.01); *E21D 9/14* (2013.01)

(58) Field of Classification Search
CPC ..... E21D 9/06; E21D 9/0635; E21D 9/14
See application file for complete search history.

(56) References Cited

U.S. PATENT DOCUMENTS 1,653,126 A * 12/1927 Schwerin ..... E21D 15/08 254/133 R
3,979,920 A * 9/1976 Burgess ..... E21D 9/0635 405/147

(Continued)

FOREIGN PATENT DOCUMENTS

CN 101532387 A 9/2009
CN 102094659 A 6/2011

(Continued)

*Primary Examiner* — Janine M Kreck
(74) *Attorney, Agent, or Firm* — Gang Yu

(57) ABSTRACT

The present disclosure provides a shield sealing device and a shield sealing method, a pile wall is arranged at a shield receiving opening, the shield sealing device is mounted on the pile wall, and the shield sealing device comprises: an elastic inner ring, an inner wall of the elastic inner ring adapting to an outer wall of a cutter head of a shield tunneling machine; and a plurality of control units, the plurality of control units being mounted on the pile wall, the plurality of control units being arranged in a circumferential direction of the elastic inner ring at intervals, and a driving end of the control part pressing against an outer side of the elastic inner ring so as to extrude or release the elastic inner ring.

11 Claims, 2 Drawing Sheets

(56) References Cited

U.S. PATENT DOCUMENTS

| | | | | | |
|---|---|---|---|---|---|
| 4,645,378 | A * | 2/1987 | Hentschel | ..... | E21D 9/0635 277/553 |
| 11,306,497 | B2 * | 4/2022 | Moss | ..... | E04G 25/04 |
| 11,603,760 | B2 * | 3/2023 | Kawasaki | ..... | E21D 11/38 |

FOREIGN PATENT DOCUMENTS

| | | | | |
|---|---|---|---|---|
| CN | 102345464 | A | | 2/2012 |
| CN | 204877504 | U | | 12/2015 |
| CN | 209385136 | U | | 9/2019 |
| CN | 209892241 | U | | 1/2020 |
| JP | 2002256800 | A | | 9/2002 |
| JP | 2004092233 | A | * | 3/2004 |
| JP | 2011246985 | A | | 12/2011 |

* cited by examiner

SHIELD SEALING DEVICE AND SHIELD SEALING METHOD

CROSS-REFERENCE TO RELATED APPLICATION(S)

The present invention is a national stage application of International Patent Application No. PCT/CN2020/088937, which is filed on 7 May 2020 and claims priority to Chinese Patent Application No. 202010239524.1, filed on 30 Mar. 2020 and entitled "Shield Sealing Device and Shield Method", the contents of which are hereby incorporated by reference in its entirety.

TECHNICAL FIELD

The present disclosure relates to a technical field of shield apparatuses, and particularly relates to a shield sealing device and a shield sealing method.

BACKGROUND

In recent years, with the development of tunnels, a shield method has been gradually introduced for construction, which is a novel underground excavation construction method and has become an important component for traffic development of various cities at home and abroad. The method has advantages of a large transport volume, a high speed, low noise, low pollution, etc., and has good ecological environment, economic and social benefits, so it is increasingly favored by people.

Shield construction is mainly divided into three stages, there are starting, normal tunneling and receiving. Wherein the receiving of a shield tunneling machine refers to a process of construction of the shield tunneling machine from a tunnel, which is being dug, to a shield construction working well, and shield receiving work is started when a cutter head cuts a blocking wall to enter the working well. A tunnel portal cord fabric and a pressing plate need to be mounted at a receiving opening, thereby realizing an effect of blocking an opening leakage channel. Due to the fact that a diameter of the cutter head is larger than those of the other parts of the shield tunneling machine, a diameter of a shield construction cutter head incision is larger than a diameter of a shield, although the shield is received forwards, water leakage and slurry leakage of the channel will still occur, and a problem of construction period delay caused by jam of the shield tunneling machine, and major disasters such as collapse of the receiving opening and ground surface settlement are prone to being caused.

Patent No. 201820986172.4 is a sealing rubber cord fabric for shield receiving construction. The utility model discloses the sealing cord fabric for the shield receiving construction, which includes a steel ring plate A, a steel ring plate B, a hinge pressing plate, a hanging ring, a steel wire rope and a cord fabric rubber plate, When a shield front body shield housing is pushed out of a tunnel portal, the hinge pressing plate is adjusted by means of the steel wire rope on the hinge pressing plate clamping ring to press the cord fabric rubber plate as tightly as possible so as to prevent tunnel portal soil and slurry from leaking out, the steel wire rope is tensioned again when a segment is dragged out of a shield tail, and therefore, the pressing plate can press the rubber cord fabric, the cord fabric always plays a sealing role, and a sealing effect is good. The patent does not consider size change of the shield tunneling machine itself and diameter difference of different parts, but changes contact between the sealing cord fabric and the shield tunneling machine manually and mechanically, and thus sealing performance of the shield tunneling machine in a whole receiving process cannot be ensured, and the shield tunneling machine is low in construction efficiency and long in consumed time; and moreover, when the cutter head gets out of the opening, due to the fact that the diameter of the cutter head of the shield tunneling machine is larger than those of the other parts of the shield tunneling machine, phenomena of the water leakage and the slurry leakage are prone to occurring at a joint due to poor sealing performance.

In order to solve the problem, at present, in general, a circle of cord fabric and the pressing plate are arranged around the shield tunneling machine receiving opening to serve as a sealing device, but due to the fact that the diameter of the cutter head of the shield tunneling machine is larger than those of the other parts of the shield tunneling machine, such a method may only play a sealing role to a certain extent, as an overall diameter tends to be gradually decreased while the shield tunneling machine gets out of the opening step by step, the sealing effect gradually become worse, so that manual step-by-step plate insertion is needed, which is long in consumed time and high in risk, accordingly, construction efficiency of the tunnel is affected, and even the major disasters such as the opening collapse and ground surface settlement may be caused.

SUMMARY

A major object of the present disclosure is to provide a shield sealing device and a shield sealing method, so as to solve a problem of poor sealing performance in an out-of-opening process of a shield tunneling machine in the prior art.

In order to realize the above object, according to one aspect of the present disclosure, the shield sealing device is provided, a pile wall is arranged at a shield receiving opening, the shield sealing device is mounted on the pile wall, and the shield sealing device includes: an elastic inner ring, an inner wall of the elastic inner ring adapting to an outer wall of a cutter head of a shield tunneling machine; and a plurality of control units, the plurality of control units being mounted on the pile wall, the plurality of control units being arranged in a circumferential direction of the elastic inner ring at intervals, and a driving end of the control part pressing against an outer side of the elastic inner ring so as to extrude or release the elastic inner ring.

Furthermore, a number of the control units is six, and the six control units are arranged in the circumferential direction of the elastic inner ring at equal intervals.

In some embodiments, the control part includes a driving device and a push plate mounted at an output end of the driving device, the push plate abutting against an outer portion of the elastic inner ring.

In some embodiments, an inner wall of the push plate is provided with a recess, the recess extending in a length direction of the push plate, and the recess adapting to an outer wall of the elastic inner ring.

In some embodiments, a reserved gap is provided between two adjacent control units of the plurality of control units, and the elastic inner ring is provided with a protrusion, the protrusion adapting to the reserved gap, and the protrusion being mounted in the reserved gap.

In some embodiments, the elastic inner ring is made of rubber, and an interior of the elastic inner ring is inflated.

In some embodiments, the driving device includes a hydraulic power device.

In some embodiments, the shield sealing device further includes a detection device, the detection device being mounted on the elastic inner ring and being used for detecting a distance between a side wall of the shield tunneling machine and the elastic inner ring.

According to another aspect of the present disclosure, the shield sealing method is provided, the shield sealing method uses the shield sealing device, and the method includes: enabling the control units to be at an initial position when the cutter head is located in the elastic inner ring; enabling the control units to extrude the elastic inner ring to a first state when a front shield of the shield tunneling machine is located in the elastic inner ring; enabling the control units to extrude the elastic inner ring to a second state when a middle shield of the shield tunneling machine is located in the elastic inner ring; and enabling the control units to extrude the elastic inner ring to a third state when a rear shield of the shield tunneling machine is located in the elastic inner ring.

In some embodiments, in the first state, the elastic inner ring extruded by the control units abuts against a side wall of the front shield of the shield tunneling machine; in the second state, the elastic inner ring extruded by the control units abuts against a side wall of the middle shield of the shield tunneling machine; and in the third state, the elastic inner ring extruded by the control units abuts against a side wall of the rear shield of the shield tunneling machine.

By applying a technical solution of the present disclosure, in an advancing process of the shield tunneling machine, an inner diameter of the shield tunneling machine is gradually reduced when the shield tunneling machine passes through the opening, and the elastic inner ring is extruded by means of the control units, so that the elastic inner ring abuts against a side wall of the shield tunneling machine, accordingly, a good opening sealing effect is realized, problems of water leakage and slurry leakage are avoided, manual plate insertion is not needed, a safety coefficient is high, and operation is convenient.

BRIEF DESCRIPTION OF THE DRAWINGS

The drawings of the description, which form a part of the disclosure, are used to provide further understanding of the present disclosure, and illustrative embodiments of the present disclosure and the description thereof are used to explain the present disclosure, which are not intended to unduly limit the present disclosure. In the drawings.

Figure 1:
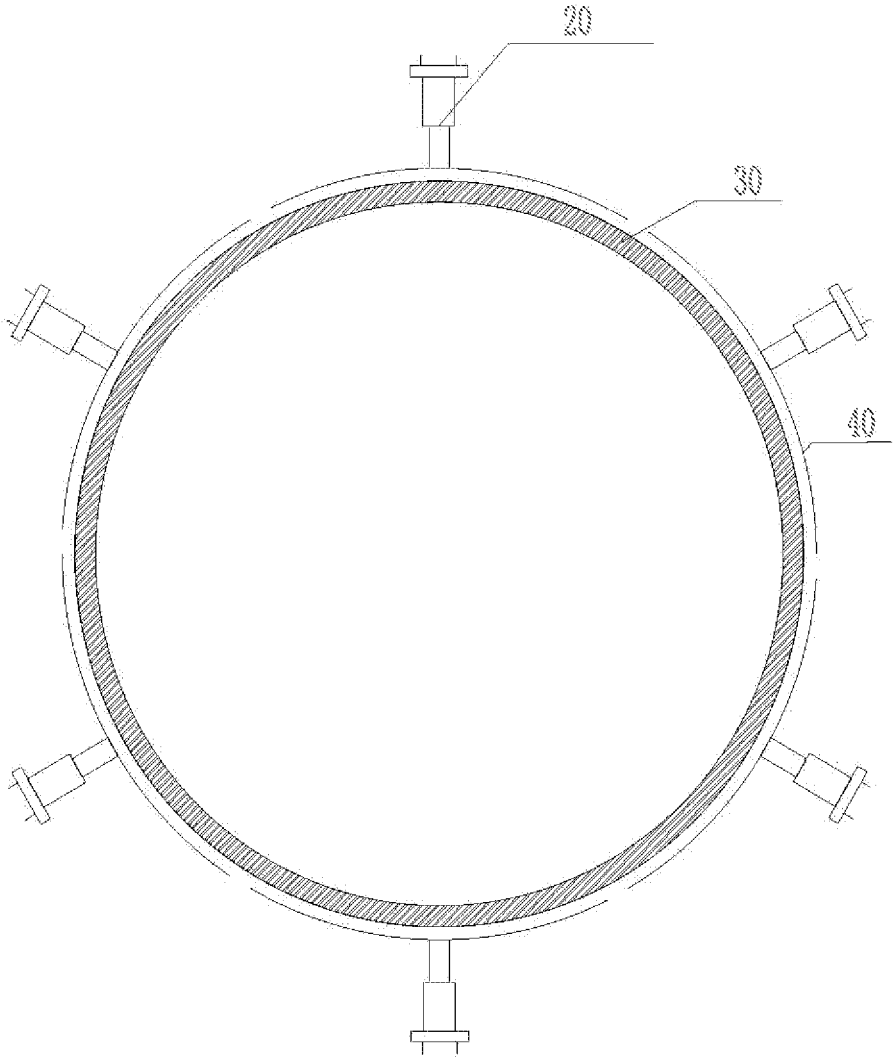
FIG. 1 illustratively shows a radial section diagram of embodiments of a shield sealing device of the present disclosure.

The drawings include the following reference numerals: 10, pile wall; 20, control unit; 30, elastic inner ring; 40, push plate; 50, cutter head; 60, front shield; 70, middle shield; and 80, rear shield.

DETAILED DESCRIPTION OF THE EMBODIMENTS

It has to be noted that on the premise of no contradiction, embodiments in the disclosure and features of the embodiments may be combined mutually. The present disclosure is described in detail below with reference to the drawings and the embodiments.

As described in the background art, at present, in general, a circle of cord fabric and a pressing plate are arranged around a shield tunneling machine receiving opening to serve as a sealing device, but due to the fact that a diameter of the cutter head of a shield tunneling machine is larger than those of the other parts of the shield tunneling machine, such a method above may only play a sealing role to a certain extent, as an overall diameter tends to be gradually decreased while the shield tunneling machine gets out of the opening step by step, a sealing effect gradually becomes worse, so that manual step-by-step plate insertion is needed, which is long in consumed time and high in risk, accordingly, construction efficiency of a tunnel is affected, and even major disasters such as opening collapse and ground surface settlement may be caused.

Figure 3:
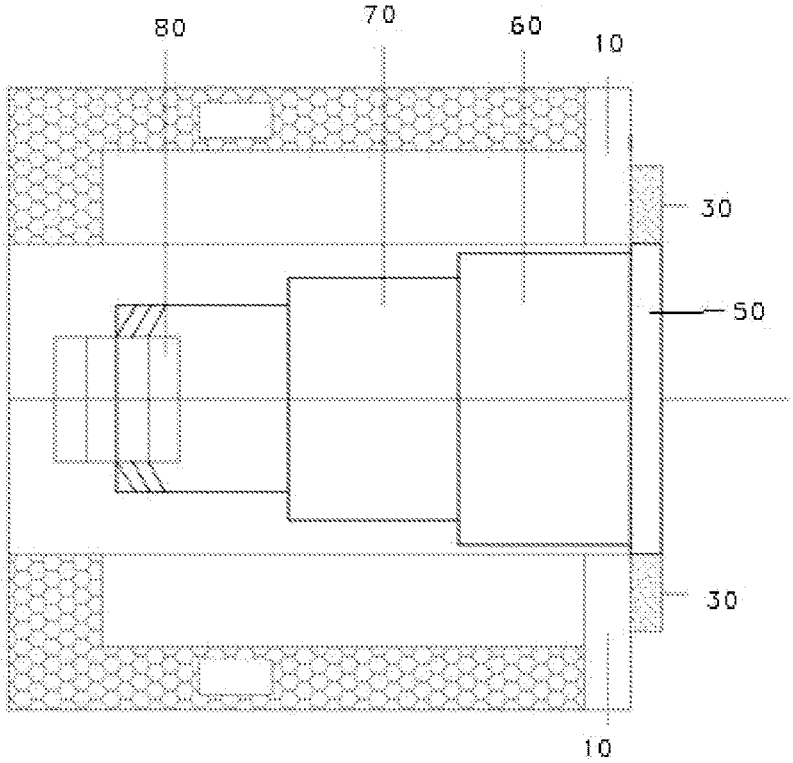
FIG. 3 illustratively shows a structural diagram of the embodiments of mounting the shield sealing device at an opening of the present disclosure.

When the shield tunneling machine gets out of the opening, the cutter head gets out of the opening firstly, but the diameter of the cutter head of the shield tunneling machine being larger than that of the other parts of the shield tunneling machine, and therefore, in an out-of-opening process of the shield tunneling machine, sealing performance of the receiving opening becomes increasingly worse. As shown in FIG. 3, the diameter of the cutter head>a diameter of the front shield>a diameter of the middle shield>a diameter of the shield tail, and thus if a sealing position is fixed, problems of water leakage and slurry leakage will occur later. A traditional method uses manual plate insertion, which is long in consumed time and high in risk.

Figure 2:
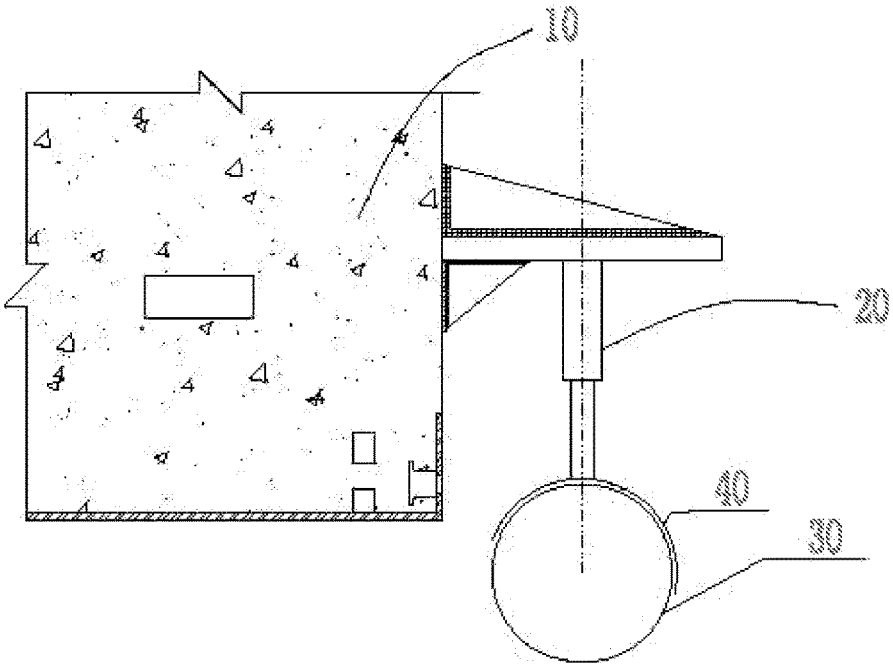
FIG. 2 illustratively shows a structural diagram of the control unit area of the shield sealing device of the present disclosure.

In order to solve the problem, as shown in FIGS. 1 to 3, the embodiments of the present disclosure provide a shield sealing device, a pile wall 10 is arranged at a shield receiving opening, the shield sealing device is mounted on the pile wall 10, and the shield sealing device includes an elastic inner ring 30 and a plurality of control units 20, wherein an inner wall of the elastic inner ring 30 adapts to an outer wall of a cutter head 50 of the shield tunneling machine, the plurality of control units 20 are mounted on the pile wall 10, the plurality of control units 20 are arranged in a circumferential direction of the elastic inner ring 30 at intervals, and a driving end of the control part 20 presses against an outer side of the elastic inner ring 30 so as to extrude or release the elastic inner ring 30. In an advancing process of the shield tunneling machine, an inner diameter of the shield tunneling machine is gradually reduced when the shield tunneling machine passes through the opening, and the elastic inner ring is extruded by means of the control unit, so that the elastic inner ring abuts against a side wall of the shield tunneling machine, accordingly, a good opening sealing effect is realized, problems of water leakage and slurry leakage are avoided, manual plate insertion is not needed, a safety coefficient is high, and operation is convenient.

Preferably, in the present embodiment, a number of the control units 20 is six, and the six control units 20 are arranged in the circumferential direction of the elastic inner ring 30 at equal intervals. Certainly, in other embodiments, a number of the control units may also be other numbers, which can realize a good sealing effect. The whole device is divided into six large areas, when pressure is applied, deformation of the elastic inner ring is facilitated, thereby adapting to change of the diameter in the out-of-opening process of the shield tunneling machine so as to ensure the sealing performance in the whole out-of-opening process.

In order to apply force to the elastic inner ring more uniformly and prevent the elastic inner ring from being damaged, in the present embodiment, the control part 20 includes a driving device and a push plate 40 mounted at an output end of the driving device, the push plate 40 abutting against an outer portion of the elastic inner ring 30. A stressed area of the elastic inner ring is increased by means of the push plate, thereby preventing the elastic inner ring from being damaged.

Preferably, in the present embodiment, an inner wall of the push plate 40 is provided with a recess, the recess adapting to an outer wall of the elastic inner ring 30. The recess extends in a length direction of the push plate 40, that is, an extending direction of the recess is the same as an extending direction of the push plate, the stressed area between the elastic inner ring and the push plate may be further increased by means of the recess, meanwhile, the recess may also limit the elastic inner ring, and then the elastic inner ring is prevented from deviating during being extruded or released. A plurality of protrusions are arranged inside the recess so as to increase friction force between the elastic inner ring and the push plate to prevent the elastic inner ring from moving.

In order to avoid mutual interference of adjacent control units 20 in an extrusion movement process, in the present embodiment, a reserved gap is provided between two adjacent control units 20 of the plurality of control units 20, and the elastic inner ring 30 is provided with a protrusion, the protrusion adapts to the reserved gap, and the protrusion dismounted in the reserved gap, and the protrusion adapts to the reserved gap through arrangement of the protrusion, so that a limiting effect can be realized to a certain extent, the elastic inner ring is further prevented from deviating, and the sealing performance is guaranteed when an overall caliber is reduced.

Preferably, in order to ensure elasticity of the elastic inner ring, in the present embodiment, the elastic inner ring 30 is made of rubber, and an interior of the elastic inner ring 30 is inflated.

In the present embodiment, the driving device includes a hydraulic power device, the hydraulic power device includes a hydraulic telescopic oil cylinder, and of course, the driving device may also use other power devices, such as a pneumatic device.

In the present embodiment, the shield sealing device further includes a detection device, the detection device being mounted on the elastic inner ring 30 and being used for detecting a distance between a side wall of the shield tunneling machine and the elastic inner ring 30, and the detection device possibly being an infrared distance sensor and may also be other distance sensors.

According to another aspect of the present disclosure, there is provided a shield sealing method, wherein the shield sealing method uses the shield sealing device, and the method includes: enabling the control units to be at an initial position when the cutter head 50 is located in the elastic inner ring 30; enabling the control units to extrude the elastic inner ring to a first state when a front shield 60 of the shield tunneling machine is located in the elastic inner ring 30; enabling the control units to extrude the elastic inner ring to a second state when a middle shield 70 of the shield tunneling machine is located in the elastic inner ring 30; and enabling the control units to extrude the elastic inner ring to a third state when a rear shield 80 of the shield tunneling machine is located in the elastic inner ring 30. The detection device is used for determining which part of the shield tunneling machine passes through the elastic inner ring.

In the first state, the elastic inner ring 30 extruded by the control units 20 abuts against a side wall of the front shield 60 of the shield tunneling machine; in the second state, the elastic inner ring 30 extruded by the control units 20 abuts against a side wall of the middle shield 70 of the shield tunneling machine; and in the third state, the elastic inner ring 30 extruded by the control units 20 abuts against a side wall of the rear shield 80 of the shield tunneling machine.

In view of the description, it may be seen that the embodiments of the present disclosure realize the following technical effects:

In an advancing process of the shield tunneling machine, an inner diameter of the shield tunneling machine is gradually reduced when the shield tunneling machine passes through the opening, and the elastic inner ring is extruded by means of the control units, so that the elastic inner ring abuts against the side wall of the shield tunneling machine, accordingly, a good opening sealing effect is realized, the problems of water leakage and slurry leakage are avoided, manual plate insertion is not needed, a safety coefficient is high, and the operation is convenient. The whole sealing device is an automatic device, in which work such as gradual manual plate insertion is not needed for guaranteeing the sealing performance of the shield tunneling machine in the out-of-opening process, and the device is safe and reliable and is high in efficiency. The sealing cord fabric in the sealing device is made of two materials, that is a steel sheet and rubber. Not only is strength of the whole shield receiving opening ensured, but also deformability of the whole sealing device is ensured.

It should be noted that the detailed description is illustrative and is intended to provide further explanation of the disclosure. All technical and scientific terms used herein have the same meanings as commonly understood by those of ordinary skill in the art to which the disclosure belongs unless otherwise indicated.

It should be noted that the terms used herein are merely for describing the detailed description of embodiments and are not intended to limit exemplary embodiments according to the disclosure. As used herein, a singular form is intended to include a plural form as well, unless the context clearly dictates otherwise, and in addition, it should be understood that the terms "includes/comprises" and/or "including/comprising", when used in the description, specify the presence of features, steps, operations, devices, assemblies, and/or groups thereof.

It should be noted that the terms "first", "second", etc., in the description and claims of the disclosure and in the drawings, are used to distinguish between similar objects and not necessarily to describe a particular order or sequential order. It should be understood that the terms so used are interchangeable under appropriate circumstances so that the embodiments of the disclosure described herein can be implemented in an order rather than those illustrated or described herein, for example.

Moreover, the terms "including/comprising" and "having" as well as any variations thereof are intended to mean covered and non-exclusive inclusion, for example, a process, a method, a system, a product or an apparatus including a series of steps or units does not need to be limited by those explicitly listed, but may include other steps or units not explicitly listed or inherent to these processes, methods, products or apparatuses.

For ease of description, spatial relative terms such as "over", "above", "on an upper surface" and "on" may be used herein to describe spatial positional relations of one device or feature with other devices or features as shown in the drawings. It should be understood that the spatial relative terms are intended to include different orientations in use or operation in addition to the orientation of the device described in the drawings.

For example, if the device in the drawings is inverted, the device described as "above" or "over" other devices or structures would then be positioned "below" or "under" the other devices or structures. Thus the exemplary term "above" may include two orientations of "above" and "below." The device may also be positioned (rotated 90 degrees or at other orientations) in other different ways and the spatial relative description used herein is interpreted accordingly.

In the above detailed description, reference is made to the drawings, which form a part hereof. In the drawings, similar symbols typically identify similar components, unless the context dictates otherwise. The illustrated embodiments described in the detailed description, the drawings, and the claims are not meant to be limiting. Other embodiments may be used, and other changes may be made, without departing from the spirit or scope of a subject presented herein. It will be easily understood that aspects of the present disclosure may be arranged, substituted, combined, separated, and designed in a wide variety of different configurations, all of which are explicitly contemplated herein, as generally described herein and illustrated in the drawings.

The present disclosure, according to the particular embodiments described in the disclosure, is not to be limited, and is intended as an illustration of the various aspects. Many modifications and changes may be made without departing from the spirit and scope of the present disclosure as will be apparent to those skilled in the art. Functionally equivalent methods and apparatuses within the scope of the present disclosure, in addition to those listed herein, will be apparent to those skilled in the art from the description. Such modifications and changes are intended to fall within the scope of the appended claims. The present disclosure is to be limited only by terms of the appended claims and the full scope of equivalents to which such claims are entitled. It is to be understood that the present disclosure is not limited to a particular method, reagent, compound, composition, or biological system, which may, of course, vary. It is also to be understood that the terms used herein are merely for describing the particular embodiments and are not intended to be limiting.

The above has been described only as preferred embodiments of the present disclosure and is not intended to limit the present disclosure, which can be modified and changed, for those skilled in the art. Any modifications, equivalent replacements, improvements, etc. made within the spirit and principles of the present disclosure should be comprised within the scope of protection of the present disclosure.

What is claimed is:

1. A shield sealing device, a pile wall is arranged at a shield receiving opening, the shield sealing device is mounted on the pile wall, and the shield sealing device comprises:

an elastic inner ring, an inner wall of the elastic inner ring adapting to an outer wall of a cutter head of a shield tunneling machine; and a plurality of control units, the plurality of control units being mounted on the pile wall, the plurality of control units being arranged in a circumferential direction of the elastic inner ring at intervals, and a driving end of each of the plurality of the control units pressing against an outer side of the elastic inner ring so as to extrude or release the elastic inner ring;

the elastic inner ring is made of rubber, and an interior of the elastic inner ring is inflated.

2. The shield sealing device as claimed in claim 1, wherein a number of the control units is six, and the six control units are arranged in the circumferential direction of the elastic inner ring at equal intervals.

3. The shield sealing device as claimed in claim 1, wherein each of the plurality of the control units comprises a driving device and a push plate mounted at an output end of the driving device, the push plate abutting against an outer portion of the elastic inner ring.

4. The shield sealing device as claimed in claim 3, wherein an inner wall of the push plate is provided with a recess, the recess extending in a length direction of the push plate, and the recess adapting to an outer wall of the elastic inner ring.

5. The shield sealing device as claimed in claim 3, wherein the driving device comprises a hydraulic power device.

6. A shield sealing method, wherein the shield sealing method uses a shield sealing device, as claimed in claim 1, and the shield sealing method comprises:

enabling the control unit to be at an initial position when the cutter head is located in the elastic inner ring;

enabling the plurality of the control units to extrude the elastic inner ring to a first state when a front shield of the shield tunneling machine is located in the elastic inner ring;

enabling the control units to extrude the elastic inner ring to a second state when a middle shield of the shield tunneling machine is located in the elastic inner ring; and enabling the control units to extrude the elastic inner ring to a third state when a rear shield of the shield tunneling machine is located in the elastic inner ring.

7. The shield sealing method as claimed in claim 6, wherein in the first state, the elastic inner ring extruded by the control units abuts against a side wall of the front shield of the shield tunneling machine;

in the second state, the elastic inner ring extruded by the control units abuts against a side wall of the middle shield of the shield tunneling machine; and in the third state, the elastic inner ring extruded by the control units abuts against a side wall of the rear shield of the shield tunneling machine.

8. The shield sealing method as claimed in claim 6, wherein a number of the control units is six, and the six control units are arranged in the circumferential direction of the elastic inner ring at equal intervals.

9. The shield sealing method as claimed in claim 6, wherein each of the plurality of the control units comprises a driving device and a push plate mounted at an output end of the driving device, the push plate abutting against an outer portion of the elastic inner ring.

10. The shield sealing method as claimed in claim 9, wherein an inner wall of the push plate is provided with a recess, the recess extending in a length direction of the push plate, and the recess adapting to an outer wall of the elastic inner ring.

11. The shield sealing method as claimed in claim 9, wherein the driving device comprises a hydraulic power device.

* * * * *